US005765488A

United States Patent [19]

Vatsky

[11] Patent Number: 5,765,488

[45] Date of Patent: Jun. 16, 1998

[54] CYCLONE FURNACE COMBUSTION SYSTEM AND METHOD UTILIZING A COAL BURNER

[75] Inventor: Joel Vatsky, West Orange, N.J.

[73] Assignee: Foster Wheeler Energy Corporation, Clinton, N.J.

[21] Appl. No.: 600,657

[22] Filed: Feb. 13, 1996

[51] Int. Cl.[6] ..... F23C 1/10

[52] U.S. Cl. ..... 110/261; 110/260; 110/263; 110/265

[58] Field of Search ..... 110/260, 261, 110/262, 263, 264, 265

[56] References Cited

U.S. PATENT DOCUMENTS

| | | | |
|---|---|---|---|
| 2,325,318 | 7/1943 | Hendrix | 431/185 |
| 2,379,490 | 7/1945 | Kruger | 110/104 |
| 4,400,151 | 8/1983 | Vatsky . | |
| 4,993,332 | 2/1991 | Boross et al. | 110/347 |
| 5,022,329 | 6/1991 | Rackley et al. . | |
| 5,052,312 | 10/1991 | Rackley et al. . | |
| 5,347,937 | 9/1994 | Vatsky . | |

*Primary Examiner*—Ira S. Lazarus
*Assistant Examiner*—Nhat-Hang H. Lam
*Attorney, Agent, or Firm*—Haynes and Boone L.L.P.

[57] ABSTRACT

A cyclone furnace combustion system and method in which a burner is mounted relative to a cyclone furnace for discharging a relatively fine particulate fuel in an axial direction into the furnace. Relatively coarse particulate fuel is discharged into the furnace in a tangential relationship thereto and air is provided in the furnace to support combustion of the fuels.

40 Claims, 1 Drawing Sheet

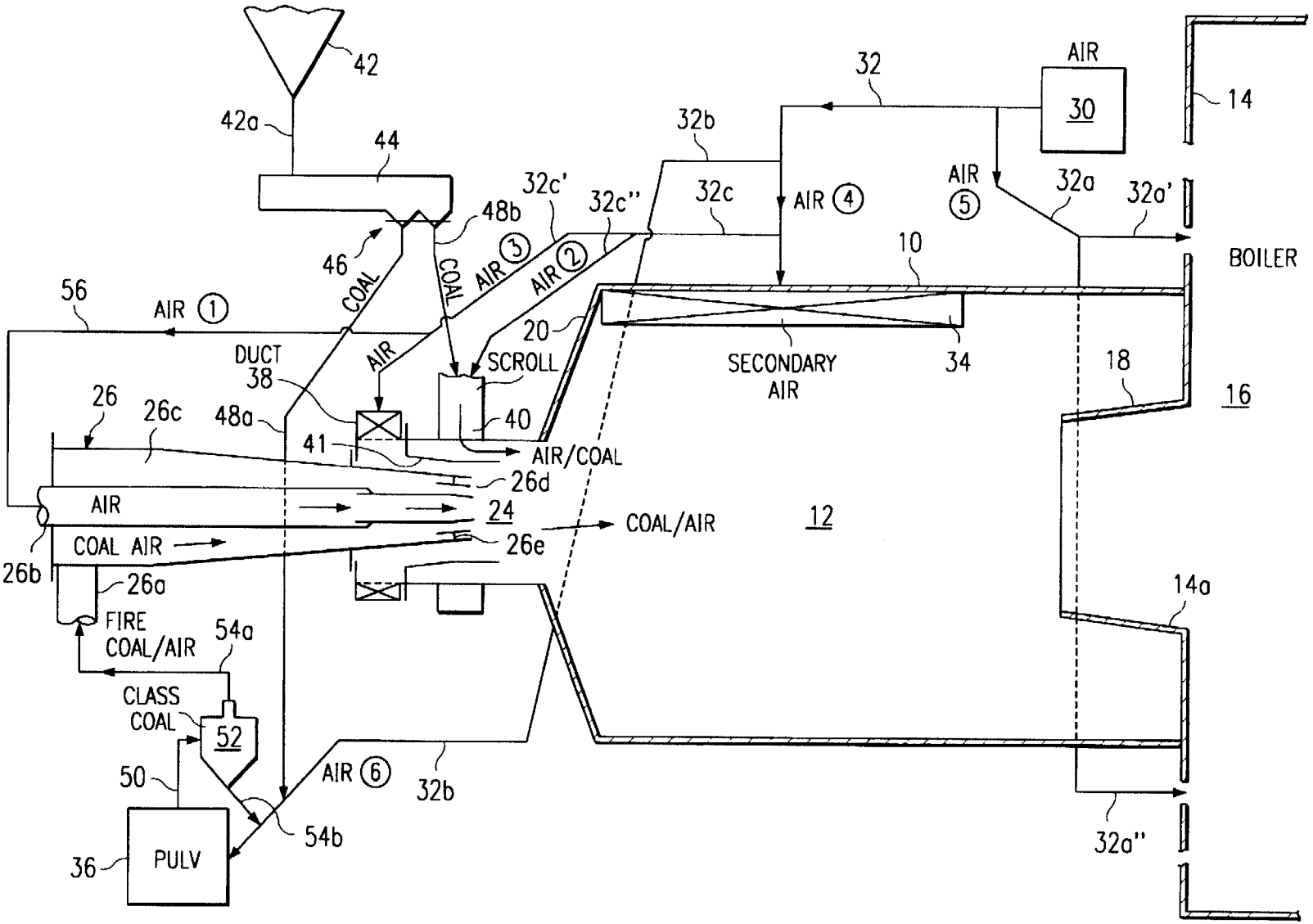
BOILER
14
16
14a
18
32a'
32a
32a''
AIR
30
AIR ⑤
34
10
32
AIR ④
SECONDARY AIR
12
32b
32c
32c''
32c'
AIR ②
AIR ③
20
SCROLL
40
AIR/COAL
26d
24
26e
COAL/AIR
48b
COAL
AIR
COAL
46
44
42
42a
41
DUCT 38
48a
AIR ①
26c
26
56
AIR
COAL AIR
26a
26b
FIRE COAL/AIR
54a
52
CLASS COAL
50
PULV
36
AIR ⑥
54b
32b

CYCLONE FURNACE COMBUSTION SYSTEM AND METHOD UTILIZING A COAL BURNER

BACKGROUND OF THE INVENTION

This invention relates to a combustion system and method and, more particularly, to such a system and method utilizing a pulverized coal burner installed in a cyclone furnace.

The most classic type of furnace is often referred to as a "pulverized coal" furnace in which pulverized coal is mixed with air, discharged through a burner, or the like, and combusted to generate heat.

However, these type furnaces are limited to a relatively high-grade coal since the ash from the lower-grade coals have a relatively low melting temperature. Therefore, if lower-grade coal is used, a relatively high percentage of the melted ash would enter the superheaters of the pulverized coal combustion furnace, and create severe slagging problems.

Also in a standard pulverized coal furnace, the coal must be reduced to very fine particles and turbulent combustion air must be supplied to the particles, to insure complete combustion. As a result, the pulverized coal furnace must be relatively large to provide sufficient residence time for the oxygen to penetrate the blanket of combustion products extending around the uncombusted particles in order to insure complete combustion.

In order to overcome these problems, a cyclone furnace has evolved in order to completely destroy the combustibles in the fuel while melting the ash into a liquid slag. In these arrangements, the cyclone furnace is disposed adjacent a main boiler furnace and fuel particles are introduced into the center of the cyclone furnace with primary air entering the burner tangentially to impart centrifugal forces to the particles. Secondary air is admitted tangentially at the roof of the cyclone barrel to increase the centrifugal action, and a small amount of tertiary air is also admitted at the center of the burner. As a result, incoming fuel particles are thrown to the walls of the cyclone and are held in the slag formed by the burning particles. Thus the particles are scrubbed by the high velocity secondary air and burned to completion before they enter the main boiler furnace. This reduces the slagging problem and enables a smaller sized furnace to be utilized.

However, these cyclone furnaces are not without problems. For example, they generate relatively high nitrogen oxides (NOx) which pollute the air. Also, all of the feed coal is injected into, and fired in, the cyclone furnace which creates a very high reducing environment the tube walls of the cyclone furnace, which can lead to catastrophic corrosion and iron formation, and subsequent wastage.

SUMMARY OF THE INVENTION

It is therefore an object of the present invention to provide a combustion system and method in which all grades of coal can be utilized while significant slagging is prevented.

It is a further object of the present invention to provide a system and method of the above type in which complete combustion is achieved without the need for a relatively large furnace.

It is a further object of the present invention to provide a system and method of the above type in which corrosion and the formation of nitrous oxides and iron sulfides are reduced.

It is a more specific object of the present invention to provide a system and method of the above type in which a pulverized coal burner, preferably of the low-nox type, is used in a cyclone furnace.

The present invention fulfills these and other objects by providing a burner mounted relative to a cyclone furnace for discharging a relatively fine particulate fuel in an axial direction into the furnace. Relatively coarse particulate fuel is discharged from an inlet scroll device into the furnace in a tangential relationship thereto and air is provided in the furnace to support combustion of the fuels. The burner divides and splits a source of particulate fuel into a plurality of streams of said fuel which, when discharged into the furnace, form a plurality of flame patterns. Additional fuel and air are introduced into said furnace in a tangential relationship thereto for combustion in the furnace.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings which is a schematic representation of the combustion system of the present invention.

DESCRIPTION OF THE PREFERRED EMBODIMENTS

Referring to the drawing, the reference numeral 10 refers, in general to a cylindrical wall defining a cyclone furnace 12. One end of the wall 10 abuts a vertical wall 14 of a main boiler 16 (shown partially). A frusto-conical wall, or throat, 18 extends from an opening **14*a* in the wall 14 to the interior of the cyclone furnace 12 for receiving combustion products from the latter furnace, as will be described. A frusto-conical wall 20 extends from the other end of the wall 10 to a cylindrical support wall 22 defining a barrel, or burner chamber 24**.

A pulverized coal burner assembly 26 is mounted adjacent the furnace 12 in a coaxial relationship, with its leading end portion extending into the burner chamber 24. The burner assembly 26 is adapted to burn pulverized coal and preferably is of the low-nox type such as those shown in U.S. Pat. No. 4,400,151 or U.S. Pat. No. 5,347,937 both of which are assigned to the assignee of the present invention and are herein incorporated by reference. Generally, an annular passage **26*c* is defined between the tubular member 26*b* and the outer casing of the assembly 26 which receives the relatively fine, pulverized coal particles from the air scroll inlet 26*a*. A conical divider 26*d* is provided at the outlet end portion of the of the assembly to divide the discharging stream of air and entrained coal particles into two radially-spaced portions which discharge into the burner chamber 24. A plurality of angular-spaced splitters 26*e* are provided in the path of the outer stream portion of air and entrained coal particles to split the latter portion into a plurality of angularly-spaced streams so that, upon ignition of the fuel particles in the chamber 24**, a plurality of angularly-spaced flame patterns are formed. This design is advantageous from several standpoints including the ability to produce multiple flame patterns and to enable increased flame shaping and, since it is fully disclosed in both of the above-cited patents, it will not be described in any further detail.

An air distribution system is provided and includes a conventional source of pressurized air 30 connected, via an air duct 32, to a duct 34 communicating with the interior of the furnace 12 to distribute the air tangentially, and at a relatively high velocity, into the furnace in a conventional manner so that the air functions as secondary air in the combustion process to be described. A branch duct 32*a* extends from the air duct 32 and splits into two portions 32*a'* and 32*a"* which extend through the wall 14 for introducing the air into the boiler 16. A branch duct 32*b* also extends from the air duct 32 to a coal pulverizer 36 to provide drying and sweep air to the pulverizer. A branch duct 32*c* also extends from the air duct 32 and splits into two portions 32*c'* and 32*c"* which extend to an inlet air duct 38 and to an air/fuel inlet scroll device 40 which are adapted to introduce air and an air/coal mixture, respectively, in a tangential relationship to the chamber 24. It is understood that dampers, or any other type of air control devices can be associated with one or more of the air ducts described above.

The scroll device 40 is of the type disclosed in applicant's pending patent application serial number (attorney's docket No. 10283.423) filed Feb. 6, 1996, and, in general, includes a tangential inlet for receiving air and crushed coal from the ducts 32*c"* and 48*b*, respectively and an annular outlet for introducing the coal and air into the chamber 24. A plurality of turning vanes are disposed in the scroll device 40 and are shaped and positioned to direct the coal and air from the inlet to the outlet. As a result, the fuel is split up as is discharges from the opening and is directed in an optimum manner so that, upon ignition of the fuel, a plurality of flame patterns are formed. The disclosure of the above pending application is hereby incorporated by reference.

A divider plate 41 is provided between the duct 38 and the scroll device 40 to direct the flows of air and air/coal mixture, respectively, into and through the chamber 24, as will be described.

The pulverizer 36 forms a part of a coal distribution system which also includes a source 42 of crushed coal, such as a silo, or the like, which is connected, via a conduit 42*a*, to a feeder 44. A volumetric coal flow divider 46 is located at the outlet of the feeder 44 and functions in a conventional manner to divide the crushed coal discharging from the feeder into two streams. A pair of conduits 48*a* and 48*b* connect the divider 46 to the air duct 32*b* and to the scroll device 40, respectively. Thus, the crushed coal from the divider 46 is distributed to the duct 32*b* and to the scroll device 40 so that the air flowing therethrough entrains the coal particles, for reasons to be described. It is understood that the divider 46 is provided with apparatus to adjust the amount of crushed coal in each of the two streams, in a conventional manner.

A duct 50 connects the outlet of the pulverizer 36 to a coal classifier 52 which receives the mixture of air and pulverized coal articles and operates in a conventional manner to separate the relatively fine coal particles from the relatively coarse particles. A conduit 54*a* connects one outlet of the classifier to an air scroll inlet 26*a* associated with the burner assembly 26 for passing the mixture of air and relatively fine coal particles tangentially into the latter assembly. A conduit 54*b* connects another outlet of the classifier 52 to the air duct 32*b* for passing the relatively coarse coal particles from the classifier to the latter duct where they mix with the air from the air source 30 and the crushed coal particles from the flow divider 46, before being reintroduced into the pulverizer 36.

A duct 56 extends from the air duct 32' to the inlet end of a center tubular member 26*b* of the burner assembly 26 for supplying a portion of the air from the latter duct to the burner assembly, for reasons to be described.

In operation, air from the source 30 is directed, via the branch duct 32*b*, to the pulverizer 36. Crushed coal from the flow divider 46 is passed through the conduit 48*a* to the branch duct 32*b* so that the air in the latter duct entrains the coal particles and carries them to the pulverizer 36 where the coal is pulverized and the air serves to dry and sweep the coal. The mixture of air and relatively fine pulverized coal then passes from the pulverizer 36 to the classifier 52 which operates to pass the coal particles exceeding a predetermined size back to the pulverizer, via the conduit 54*a*, and to permit all particles not exceeding this predetermined size to pass, along with some of the air, through the conduit 54*a* and to the inlet 26*a* of the burner assembly 26. This mixture of relatively fine coal particles and air then passes through the length of the annular chamber 26*c*, is split into two radially-spaced streams and a plurality of angularly-spaced streams as described above, before discharging from the burner assembly 26 into the chamber 24.

An additional supply of air from the source 30 is passed, via the branch duct 32*c*, the branch duct portion 32*c'* and the duct 56, to the inlet end of the tubular member 26*b* where it passes through the length of the latter member before discharging through its other end into the chamber 24 where it is surrounded by, and mixed with, the plurality of fuel-air streams discussed above. After initial ignition of the fuel in the discharging fuel-air streams in any known manner, a plurality of flame patterns are formed, with the combustion being aided by the additional air from the tubular member 26*b*.

Air from the source 30, the branch duct 32*c*, and the duct portion 32*c"*, along with crushed coal from the divider 46 and the conduit 48*b*, are passed into the scroll device 40 where they are mixed and separated into separated streams as discussed above. The crushed coal is entrained by the air in the scroll device 40 before being introduced into the chamber 24 in the manner discussed above, where it is combusted.

Additional air from the source 30 is passed, via the branch duct 32*c* and the duct portion 32*c'* to the duct 38 for introduction into the chamber 24 in a tangential relationship thereto. During this air movement, the divider plate 41 functions to maintain the layer of air from the duct 38 separate from the layer of coal and air from the scroll device 40 and closer to the burner 26. The air from the duct 38 swirls into the chamber 24 and promotes the aforementioned combustion of the streams of coal discharging from the burner 26 and from the scroll device 40, and establishes a vortex of combustion gases that passes from the chamber 24, through the furnace 12 and into the boiler 16, via the throat 18. This tangentially directed air from the duct 38 also propels the crushed fuel particles entering the chamber 24 from the scroll device 40 against the walls of the chamber 24 and the furnace 12 by centrifugal force, which particles are held in the slag formed in the lower portion of the furnace.

Still more air from the source 30 is passed, at a relatively high velocity, through the duct 32 and into the duct 34 associated with the furnace 12 and thus enters the furnace 12 in a tangential relationship thereto. This air serves as a source of secondary air in the furnace 12, scrubs the fuel particles held in the slag and establishes and promotes the recirculation of the hot gases into the above-mentioned vortex.

Since the amount of air supplied in this process is less than that required for complete combustion, air from the source 30 is passed through the branch duct 32*a*, the duct portions 32*a'* and 32*a"* and into the interior of the boiler 16 to supply an additional quantity of air to complete the combustion in the boiler.

The present invention has several advantages over the prior art. For example, it enables the features of the low-nox burner 26 to be used in a cyclone furnace environment. To this end, it provides relatively fine, pulverized coal for the low-nox burner 26 and relative coarse coal for the scroll device 40 to assist in the combustion process. Also, the low-nox burner 26 provides increased flame shaping and produces multiple flame patterns which results in a greater flame radiation, a lower average flame temperature and a shorter residence time of the gas components within the flame at a maximum temperature, all of which contribute to reduce the formations of nitric oxides. Further, the air required to burn the coal is quickly supplied and the products of combustion are rapidly removed which enables a relatively low-grade coal to be utilized while slagging, corrosion and the formation of iron sulfides are reduced. Finally, all of this is achieved without the need for a relatively large furnace.

It is understood that several variations may be made in the foregoing without departing from the scope of the invention. For example the present invention is not limited to the specific burner assembly disclosed above but can utilize other coal-burning nozzles.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A combustion system for introducing combustion products into a boiler through an opening in a wall of the boiler, the system comprising a furnace disposed adjacent the boiler wall and having an outlet communicating with the opening, a burner having an outlet for discharging fuel into the furnace, a scroll for discharging additional fuel into the furnace, a source of air, a first conduit connecting the source of air to the burner for passing air to the burner for mixing with the fuel discharging from the burner, a second conduit connecting the source of air to the scroll for passing air to the scroll for mixing with the fuel discharging from the scroll, a third conduit connecting the source of air to the furnace for passing air into the furnace upstream of the burner outlet and the scroll in a combustion-supporting relation to the fuel discharging from the burner and the scroll, wherein the combustion gases and the uncombusted fuel pass from the furnace into the boiler, and a fourth conduit connecting the source of air to the boiler for passing the air in a combustion-supporting relation to the uncombusted fuel in the boiler.

2. The system of claim 1 further comprising a fifth conduit connecting the source of air to the furnace for passing air into the furnace downstream of the burner outlet and the scroll in a combustion-supporting relation to the fuel discharging from the burner and the scroll.

3. The system of claim 2 wherein the air from the fourth conduit is introduced tangentially into the furnace downstream of the scroll, serves as secondary air for the combustion of the fuel, scrubs the fuel particles, and promotes the recirculation of the combustion products into the vortex.

4. The system of claim 1 wherein the air introduced into the burner, the scroll and the furnace is insufficient to complete combustion of the fuel and wherein the air introduced from the fifth conduit to the boiler is sufficient to complete combustion.

5. The system of claim 1 wherein the fuel is discharged from the burner in a axial direction into the furnace and wherein the fuel is discharged from the scroll in a direction perpendicular to the axial direction and towards the burner outlet.

6. The system of claim 1 wherein the furnace is formed by a wall having a circular cross section and wherein the fuel and air from the scroll discharge in a tangential relation to the furnace wall.

7. The system of claim 6 wherein the air from the second and third conduits discharges in a tangential relation to the furnace wall.

8. The system of claim 1 further comprising a source of fuel, a fuel pipe for passing a portion of the fuel to the scroll, a fuel pipe for passing another portion of the fuel to a pulverizer for pulverizing the latter fuel, and a fuel pipe for passing the pulverized fuel to the burner.

9. The system of claim 8 further comprising a sixth conduit for connecting the source of air to the pulverizer for mixing with the other portion of fuel before it is passed to the pulverizer.

10. The system of claim 1 wherein the fuel is in the form of crushed fuel particles and wherein the air from the third conduit is introduced tangentially into the furnace upstream of the outlet of the burner for establishing a vortex of combustion gases that pass through the furnace and into the boiler and for propelling the crushed fuel particles against the walls of the furnace.

11. A method for introducing combustion products into a boiler through an opening in a wall of the boiler, the method comprising the steps of providing a furnace adjacent the boiler wall and having an outlet communicating with the opening, discharging a first quantity of fuel into an area of the furnace, discharging a second quantity of fuel into the area, passing air to the first quantity of fuel for mixing with the latter fuel, passing air to the second quantity of fuel for mixing with the latter fuel, passing air into the furnace upstream of the area in a combustion-supporting relation to the fuel, wherein the combustion gases and the uncombusted fuel pass from the furnace into the boiler, and passing air into the boiler in a combustion-supporting relation to the uncombusted fuel.

12. The method of claim 11 wherein the air introduced into the furnace is insufficient to complete combustion of the fuel and wherein the air introduced into the boiler is sufficient to complete combustion.

13. The method of claim 11 further comprising the step of passing air into the furnace downstream of the area in a combustion-supporting relation to the first and second quantities of fuel.

14. The method of claim 13 wherein the last step of passing comprises the step of passing the air tangentially into the furnace downstream of the area whereby it serves as secondary air for the combustion of the fuel, scrubs the fuel particles, and promotes the recirculation of the combustion products into the vortex.

15. The method of claim 11 wherein the first quantity of fuel is discharged into the furnace in an axial direction, and wherein the second quantity of fuel is discharged in a direction perpendicular to the axial direction and towards the discharging first quantity of fuel.

16. The method of claim 11 wherein the furnace is formed by a wall having a circular cross section and wherein the second quantity of fuel and the air that is mixed with the latter fuel are discharged in a tangential relation to the furnace wall.

17. The method of claim 16 wherein the air that is discharged into the furnace according to the third step of passing is discharged in a tangential relation to the furnace wall.

18. The method of claim 11 wherein the first quantity of fuel is crushed coal and wherein the second quantity of fuel is pulverized coal.

19. The method of claim 18 further comprising the step of passing air to the pulverized coal before the first step of discharging.

20. The method of claim 11 wherein the fuel is in the form of crushed fuel particles and wherein the third step of passing comprises the step of passing the air tangentially into the furnace upstream of the furnace area for establishing a vortex of combustion gases that pass through the furnace and into the boiler and for propelling the crushed fuel particles against the walls of the furnace.

21. A combustion system for introducing combustion products into a boiler through an opening in a wall of the boiler, the system comprising a furnace disposed adjacent the boiler wall and having an outlet communicating with the opening, a burner having an outlet for discharging fuel into the furnace, a scroll for discharging additional fuel into the furnace, a source of air, a first conduit connecting the source of air to the burner for passing air to the burner for mixing with the fuel discharging from the burner, a second conduit connecting the source of air to the scroll for passing air to the scroll for mixing with the fuel discharging from the scroll, a third conduit connecting the source of air to the furnace for passing air into the furnace upstream of the burner outlet and the scroll in a combustion-supporting relation to the fuel discharging from the burner and the scroll, and a fourth conduit connecting the source of air to the furnace for passing air into the furnace downstream of the burner outlet and the scroll in a combustion-supporting relation to the fuel discharging from the burner and the scroll, wherein the combustion gases and the uncombusted fuel pass from the furnace into the boiler.

22. The system of claim 21 further comprising a fifth conduit connecting the source of air to the boiler for passing the air in a combustion-supporting relation to the uncombusted fuel in the boiler.

23. The system of claim 22 wherein the air introduced into the burner, the scroll and the furnace is insufficient to complete combustion of the fuel and wherein the air introduced from the fifth conduit to the boiler is sufficient to complete combustion.

24. The system of claim 21 wherein the fuel is discharged from the burner in an axial direction into the furnace and wherein the fuel is discharged from the scroll in a direction perpendicular to the axial direction and towards the burner outlet.

25. The system of claim 21 wherein the furnace is formed by a wall having a circular cross section and wherein the fuel and air from the scroll discharge in a tangential relation to the furnace wall.

26. The system of claim 25 wherein the air from the second, third and fourth conduits discharges in a tangential relation to the furnace wall.

27. The system of claim 21 further comprising a source of fuel, a fuel pipe for passing a portion of the fuel to the scroll, a fuel pipe for passing another portion of the fuel to a pulverizer for pulverizing the latter fuel, and a fuel pipe for passing the pulverized fuel to the burner.

28. The system of claim 27 further comprising a sixth conduit for connecting the source of air to the pulverizer for mixing with the other portion of fuel before it is passed to the pulverizer.

29. The system of claim 21 wherein the fuel is in the form of crushed fuel particles and wherein the air from the third conduit is introduced tangentially into the furnace upstream of the outlet of the burner for establishing a vortex of combustion gases that pass through the furnace and into the boiler and for propelling the crushed fuel particles against the walls of the furnace.

30. The system of claim 29 wherein the air from the fourth conduit is introduced tangentially into the furnace downstream of the scroll, serves as secondary air for the combustion of the fuel, scrubs the fuel particles, and promotes the recirculation of the combustion products into the vortex.

31. A method for introducing combustion products into a boiler through an opening in a wall of the boiler, the method comprising the steps of providing a furnace adjacent the boiler wall and having an outlet communicating with the opening, discharging a first quantity of fuel into an area of the furnace, discharging a second quantity of fuel into the area, passing air to the first quantity of fuel for mixing with the latter fuel, passing air to the second quantity of fuel for mixing with the latter fuel, passing air into the furnace upstream of the area in a combustion-supporting relation to the first and second quantities of fuel, and passing air into the furnace downstream of the area in a combustion-supporting relation to the first and second quantities of fuel, wherein the combustion gases and the uncombusted fuel pass from the furnace into the boiler.

32. The method of claim 31 further comprising the step of passing air into the boiler in a combustion-supporting relation to the uncombusted fuel.

33. The method of claim 32 wherein the air introduced into the furnace is insufficient to complete combustion of the fuel and wherein the air introduced into the boiler is sufficient to complete combustion.

34. The method of claim 31 wherein the first quantity of fuel is discharged into the furnace in an axial direction, and wherein the second quantity of fuel is discharged in a direction perpendicular to the axial direction and towards the discharging first quantity of fuel.

35. The method of claim 31 wherein the furnace is formed by a wall having a circular cross section and wherein the second quantity of fuel and the air that is mixed with the latter fuel are discharged in a tangential relation to the furnace wall.

36. The method of claim 35 wherein the air that is discharged into the furnace according to the last two steps of passing is discharged in a tangential relation to the furnace wall.

37. The method of claim 31 wherein the first quantity of fuel is crushed coal and wherein the second quantity of fuel is pulverized coal.

38. The method of claim 37 further comprising the step of passing air to the pulverized coal before the first step of discharging.

39. The method of claim 31 wherein the fuel is in the form of crushed fuel particles and wherein the third step of passing comprises the step of passing the air tangentially into the furnace upstream of the furnace area for establishing a vortex of combustion gases that pass through the furnace and into the boiler and for propelling the crushed fuel particles against the walls of the furnace.

40. The method of claim 39 wherein the fourth step of passing comprises the step of passing the air tangentially into the furnace downstream of the area whereby it serves as secondary air for the combustion of the fuel, scrubs the fuel particles, and promotes the recirculation of the combustion products into the vortex.

* * * * *